US009355767B2

(12) United States Patent
Gluskin et al.

(10) Patent No.: US 9,355,767 B2
(45) Date of Patent: May 31, 2016

(54) UNDULATOR WITH DYNAMIC COMPENSATION OF MAGNETIC FORCES

(71) Applicant: UChicago Argonne, LLC, Chicago, IL (US)

(72) Inventors: Efim Gluskin, Darien, IL (US); Emil Trakhtenberg, Darien, IL (US); Joseph Z. Xu, Naperville, IL (US)

(73) Assignee: UChicago Argonne, LLC, Chicago, IL (US)

( * ) Notice: Subject to any disclaimer, the term of this patent is extended or adjusted under 35 U.S.C. 154(b) by 0 days.

(21) Appl. No.: 14/476,293

(22) Filed: Sep. 3, 2014

(65) Prior Publication Data

US 2016/0064129 A1 Mar. 3, 2016

(51) Int. Cl.
*H01F 7/02* (2006.01)
*H05H 7/04* (2006.01)

(52) U.S. Cl.
CPC ..... *H01F 7/0231* (2013.01); *H01F 7/0221* (2013.01); *H01F 7/0278* (2013.01); *H05H 7/04* (2013.01); *H05H 2007/041* (2013.01)

(58) Field of Classification Search
CPC ..... H05H 7/04; H01F 7/0278; H01F 7/06; H01F 7/0221
USPC ..... 335/216, 296, 302–306
See application file for complete search history.

(56) References Cited

U.S. PATENT DOCUMENTS

| | | | | |
|---|---|---|---|---|
| 6,831,933 | B2 | 12/2004 | Biedron et al. | |
| 6,858,998 | B1 * | 2/2005 | Shenoy | H05H 13/04 315/501 |
| 7,956,557 | B1 | 6/2011 | Waterman | |
| 8,134,440 | B2 | 3/2012 | Beckenbach et al. | |
| 2001/0004105 | A1 * | 6/2001 | Kwan | G03F 7/70733 250/492.2 |
| 2007/0210795 | A1 * | 9/2007 | Motoshiromizu | G01R 33/3802 324/318 |

* cited by examiner

*Primary Examiner* — Bernard Rojas
(74) *Attorney, Agent, or Firm* — Joan Pennington

(57) ABSTRACT

A method and apparatus for implementing dynamic compensation of magnetic forces for undulators are provided. An undulator includes a respective set of magnet arrays, each attached to a strongback, and placed on horizontal slides and positioned parallel relative to each other with a predetermined gap. Magnetic forces are compensated by a set of compensation springs placed along the strongback. The compensation springs are conical springs having exponential-force characteristics that substantially match undulator magnetic forces independently of the predetermined gap. The conical springs are positioned along the length of the magnets.

20 Claims, 12 Drawing Sheets

200

320

400

420

500

600

620

700

720

UNDULATOR WITH DYNAMIC COMPENSATION OF MAGNETIC FORCES

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to undulators for synchrotron radiation and free electron laser (FEL) sources, and more particularly, relates to a method and apparatus for implementing dynamic compensation of magnetic forces for undulators.

DESCRIPTION OF THE RELATED ART

A known synchrotron radiation source is the Advanced Photon Source (APS) at Argonne National Laboratory. The Advanced Photon Source (APS) at Argonne National Laboratory is a national synchrotron-radiation light source research facility. Utilizing high-brilliance x-ray beams from the APS, members of the international synchrotron-radiation research community carry out forefront basic and applied research in the fields of materials science; biological science; physics; chemistry; environmental, geophysical, and planetary science; and innovative x-ray instrumentation.

The Advanced Photon Source (APS) is a third-generation synchrotron radiation source that stores ultrarelativistic electrons in a storage ring. The third-generation synchrotron radiation sources are designed to have low beam emittance and many straight sections for insertion devices, undulator magnets. This makes for a bright beam of x-rays; however the x-ray pulses are long (10-100 picoseconds) and incoherent longitudinally and only partially coherent in the transverse dimension. This incoherence arises from the fact that this radiation is spontaneously, or randomly, emitted from the electrons.

U.S. Pat. No. 8,134,440 B2, entitled Planar-Helical Undulator issued Mar. 13, 2012 to Max Beckenbach et al., discloses a planar-helical undulator for emitting 360° electrically variable photo radiation, including a first coil and a second coil disposed relative to an undulator axis, an axis of the first coil and an axis of the second coil and the undulator axis being parallel to each other, and the undulator axis forming a portion of a synchrotron beam axis. Further, each of the first and second coils includes a helical section and a planar section. The windings of each respective section are connected in series, so that the planar section generates, when energized, a first magnetic field, and so that the helical section generates, when energized, a second magnetic field. Each planar section is disposed around the corresponding helical section, and at least one of the helical section and the planar section of at least one of the coils includes variable windings changing symmetrically over a length of the respective section towards a middle of the respective section.

Undulators are also known as wigglers and Insertion Devices (IDs). The majority of synchrotron radiation (SR) sources, including free electron lasers (FEL), utilize IDs with a vertically oriented magnetic field. This preferential direction is the result of the strong asymmetry; the horizontal size is much larger than the vertical one, of the electron beam cross-section in the storage rings, which is the main source of SR. Although e-beam in FELs is quite symmetric in the transverse plane, ID designers have not taken real advantage of it so far. This status quo could soon be changed because of recent advancements in the design of ultra small emittance storage rings. Such machines promise to operate with round e-beams and execute on-axis injection. Therefore developments of novel planar IDs with horizontal magnetic fields become a practical matter.

There are at least two major advantages of rotating ID geometry by 90 degrees. One is related to the rotation of the polarization plane of emitted radiation, which results in the transformation of monochromators and experimental set-ups to the gravity neutral systems. In many cases it would significantly simplify the construction and operation of these set-ups. The second advantage is also related to the gravity neutral design, but now applies to the undulator mechanical system. When such a design is combined with the magnetic force compensation system, the ID gap drive mechanism could become quite compact without sacrificing stringent requirements on the accuracy and reproducibility of the ID gap control.

Currently known FELs around the world utilize the traditional approach in the designs of ID gap drive mechanisms, regardless of the type of IDs: out of vacuum, in-vacuum, APPLE-type, and the like. These designs are loaded with very strong, often bulky beams that are able to withstand tremendous magnetic forces without noticeable distortions, and with very precise mechanical components that permit control of the ID magnetic gap value at a micron level. Typically the fabrication of such devices requires unique machine tools that can process several meter beams within a few microns of precision.

U.S. Pat. No. 7,956,557, entitled Support Structures for Planar Insertion Devices issued Jun. 7, 2011 to David John Waterman, discloses a planar insertion device and supporting structure for a planar insertion device for treating a synchrotron radiation beam that includes a primary frame on which at least two secondary C-frames are mounted. An upper and lower girders are mounted on the secondary C-frames forming a gap between girders and arranged substantially horizontally and parallel to each other and to the synchrotron radiation beam. Magnetic arrays rigidly mounted on the girders are facing each other and facing the gap between girders, with the synchrotron radiation beam passing between the magnetic arrays through the gap. The planar insertion device supporting structure includes compensation linear springs. The planar insertion device supporting structure is arranged to prevent detrimental deformation reactions to variations of magnetic loadings with changes in the gap and subsequent geometrical misalignment.

It is desirable to provide an enhanced method and apparatus for implementing dynamic compensation of magnetic forces for undulators.

SUMMARY OF THE INVENTION

Principal aspects of the present invention are to provide a method and apparatus for implementing dynamic compensation of undulators magnetic forces that exhibit exponential behavior with the distance changing between undulator magnetic arrays or gap changing. Other important aspects of the present invention are to provide such method and apparatus for implementing dynamic compensation of magnetic forces for undulators substantially without negative effect and that overcome some of the disadvantages of prior art arrangements.

In brief, a method and apparatus for implementing dynamic compensation of magnetic forces for undulators are provided. An undulator includes a respective set of magnet arrays, each attached to a strongback, and placed on horizontal slides and positioned parallel relative to each other with a predetermined gap. Magnetic forces are compensated by a set of compensation springs placed along the strongback. The compensation springs are conical springs having exponential-force characteristics that substantially match undulator magnetic forces independently of the predetermined gap. The conical springs are positioned along the length of the magnets.

In accordance with features of the invention, a mechanical design of spring cages is provided that enables both reliable and reproducible generation of the compensation force.

In accordance with features of the invention, the compensation springs are conical wire springs with constant wire cross section.

In accordance with features of the invention, the load characteristics of an individual compensation spring is set according to a predefined magnetic force of the undulator.

In accordance with features of the invention, overall load characteristics of the springs in a spring cage block can be steeper or flatter than the predefined magnetic force of the undulator when the difference between magnetic force and spring compensation force is less than a predefined allowable actuator force, such as 100 kg/actuator, and the gap distortion, resulted by the differential torque on the strongback, is less than a predefined tolerance, such as ±1 micron tolerance.

In accordance with features of the invention, a tuning process includes sorting spring sets to achieve predefined matching of overall spring curve and magnetic curve.

In accordance with features of the invention, at least one force load cell and at least one absolute encoder are provided to determine the spring load settings and an operational gap range.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and apparatus for implementing dynamic compensation of magnetic forces for undulators are provided.

Figure 1:
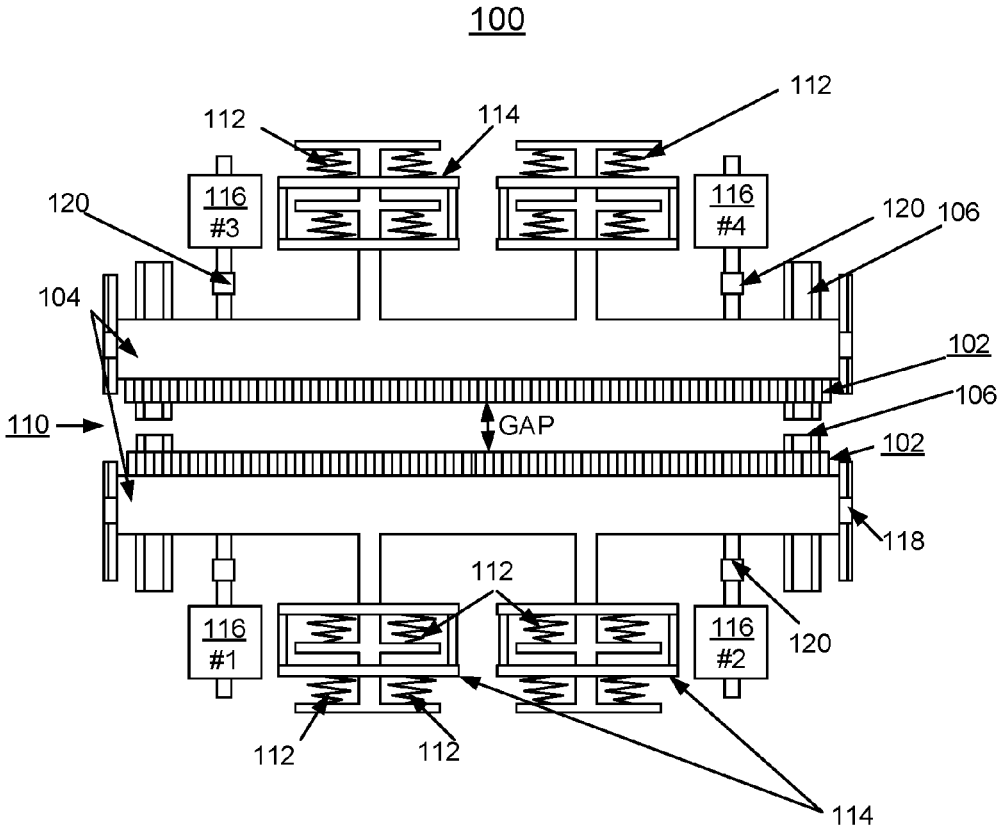
FIG. 1 schematically illustrates not to scale an example undulator with apparatus for implementing dynamic compensation of magnetic forces in accordance with a preferred embodiment.

Having reference now to the drawings, in FIG. 1, there is shown an example undulator including example apparatus for implementing dynamic compensation of magnetic forces generally designated by the reference character 100 in accordance with a preferred embodiment.

The undulator 100 includes a respective set of magnet arrays 102. Each magnet array 102 is attached to a strongback 104, and placed on horizontal slides 106 and positioned parallel relative to each other with a predetermined gap generally designated by the reference character 110. Magnetic forces of the sets of magnets 102 are compensated by a set of compensation springs 112 provided with respective spring cages 114 placed along the strongback 104. The undulator 100 includes a plurality of actuators 116, #1-4, one or more encoders 118, and a plurality of load cells 120.

In accordance with features of the invention, the compensation springs 112 are conical springs having predetermined exponential force characteristics. The conical springs 112 are positioned along the length of the magnet arrays 102.

The choice of the compensation springs 112 is defined foremost by the gap dependence of the magnetic force. Generally, it is an exponential function with parameters derived from the ID magnetic characteristics. The development of the specifications for the compensation springs 112 starts with the calculation of the ID magnetic force as a function of the magnetic gap. These calculations for the short prototype have been carried out by OPERA for the gap range from 7.2 mm up to 20 mm. Calculation results are shown on FIG. 2, and define required characteristics of the compensation springs 112.

Figure 2:
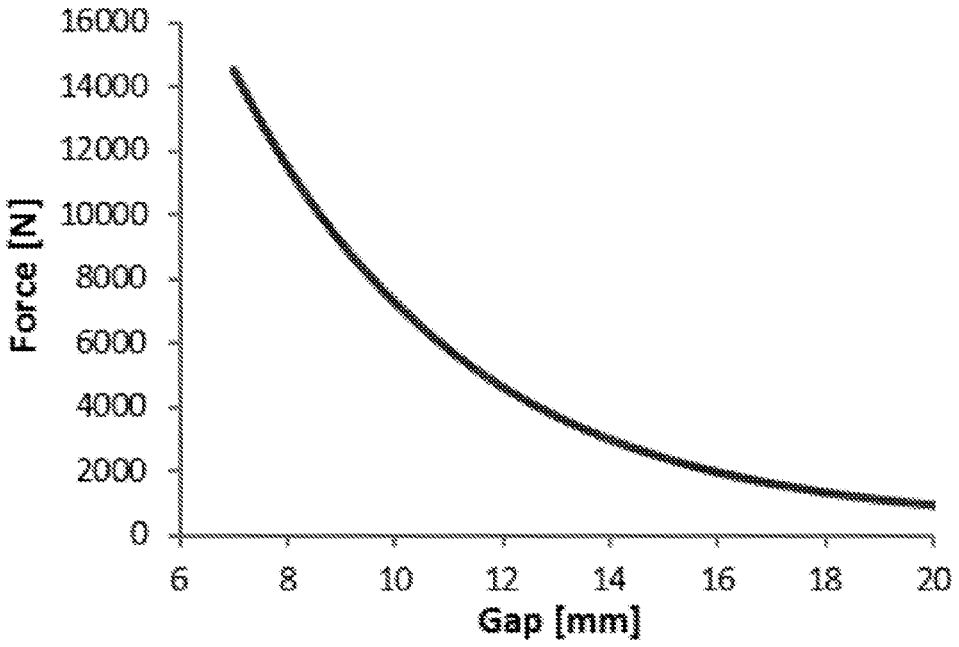
FIG. 2 is a chart illustrating gap dependence of magnetic force for the example undulator of FIG. 1 in accordance with preferred embodiments.

Referring also to FIG. 2, there is shown an example curve generally designated by the reference character 200 illustrating gap dependence of magnetic force for the example undulator 100 of FIG. 1 in accordance with preferred embodiments. In FIG. 2, force is shown with respect to the vertical axis and gap 110 is shown with respect to the horizontal axis.

Compensation springs 112 with the exponential compression characteristics that followed the curve 200 of FIG. 2 represent the best design choice, while such springs are not an off the shelf product. Therefore, in the initial design study, the use of readily available springs with linear characteristics has been investigated. Such springs can closely extrapolate the required gap dependence curve only if a significant number of them are used. Each spring gets engaged at the appropriate gap, and therefore the exponential curve of the magnetic force can be approximated by several linear segments. But such an approach could lead to problems with the required gap reproducibility and therefore it has not been explored beyond the stage of conceptual design.

The final prototype design apparatus 100 exploits springs 112 with exponential load characteristics. These types of springs could be manufactured per customer specifications. Such an approach significantly simplifies the mechanical design of spring cages 114, and leads to the reliable and reproducible generation of the compensation force. It also turns out that the design and manufacturing cost of customized springs is not that far from commercially available linear springs. And since the required number of custom-made springs 112 is less than linear ones, the net result definitely favors the custom-made springs.

Figure 3A:
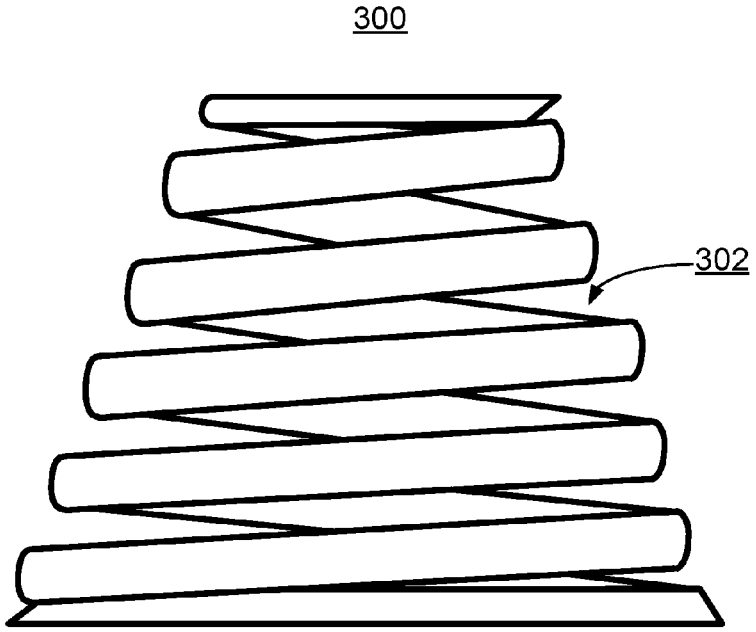
FIG. 3A illustrates an example conical spring of the example apparatus for implementing dynamic compensation of magnetic forces in accordance with a preferred embodiment of FIG. 1

Referring to FIG. 3A, there is shown an example conical spring generally designated by the reference character 300 of the example apparatus of the dynamic compensation of magnetic forces of undulator 100 for implementing compensation springs 112 in accordance with a preferred embodiment. The conical wire springs 300 include a constant wire cross section 302 of the wire forming the conical wire springs.

Figure 3B:
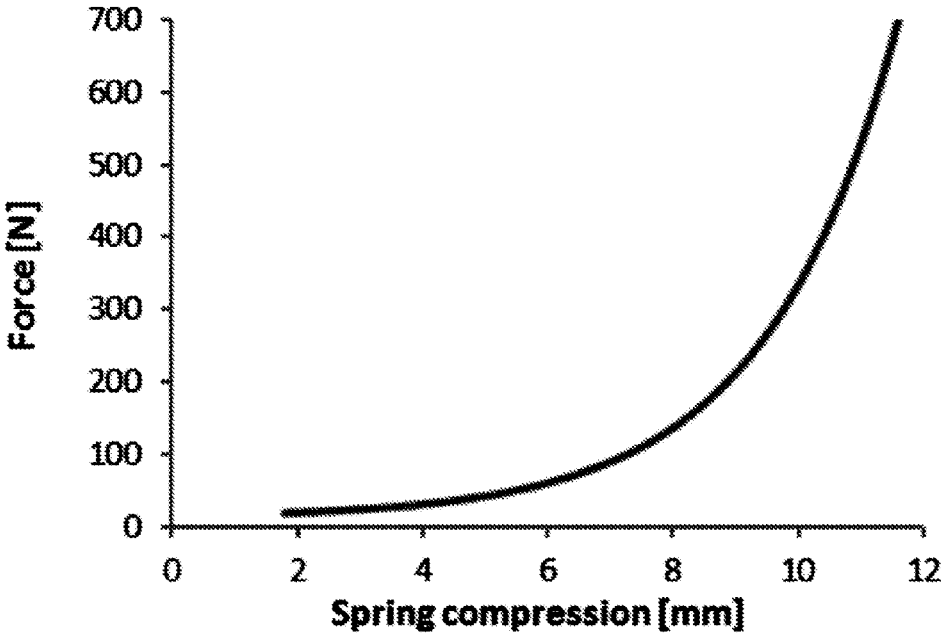
FIG. 3B illustrates example spring force versus spring compression for the example conical spring of FIG. 3A in accordance with a preferred embodiment.

Referring to FIG. 3B, illustrates example spring force versus spring compression generally designated by the reference character 320 for the example conical spring 300 of FIG. 3A in accordance with a preferred embodiment. In FIG. 3B, force in N is shown with respect to the vertical axis and spring compression in mm is shown with respect to the horizontal axis. The load characteristics of an individual spring 300, as shown in FIG. 3B were set according to a previously defined magnetic forces of undulator 100.

Figure 4A:
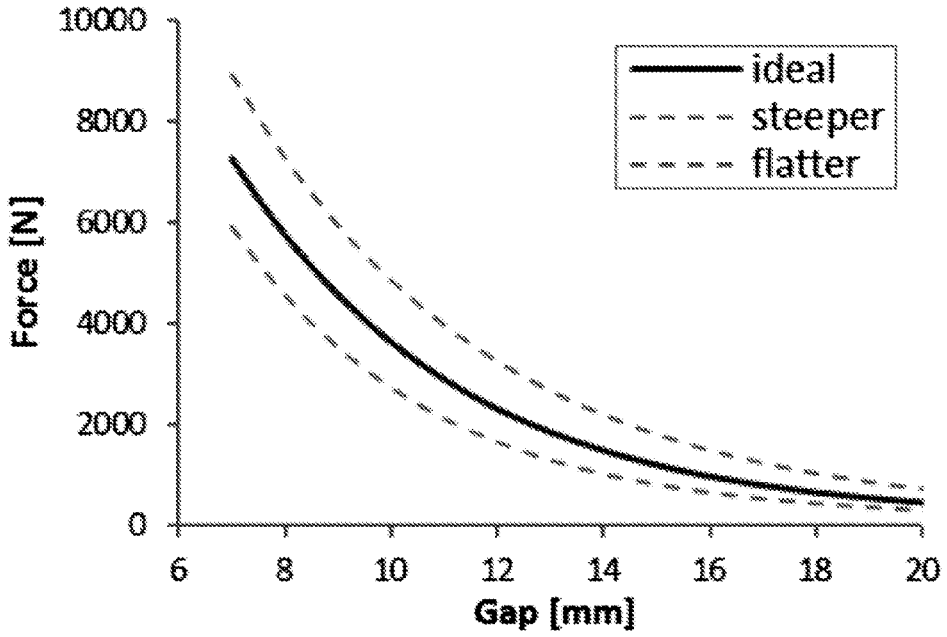
FIG. 4A illustrates example spring forces versus gap for the example conical spring cage of FIG. 1 in accordance with a preferred embodiment.

Referring to FIG. 4A, there are shown example spring forces versus gap generally designated by the reference character 400 for the example conical spring cage 114 of FIG. 1 in accordance with a preferred embodiment. In FIG. 4A, force in N is shown with respect to the vertical axis and gap 110 in mm is shown with respect to the horizontal axis. Some important aspects of the springs 112, and 300 with non-linear load characteristics that should be understood. Since the spring's characteristics cannot perfectly match magnetic force curve, there may be a case when overall load characteristics of the springs in a spring cage block is steeper or flatter than the specified. It is acceptable, if the difference between magnetic force and spring's compensation force stays well below allowable actuator's force, such as 100 kg/actuator 116 used, and the ID gap distortion, resulted by the differential torque on the ID strongback 104 is less than or equal to ±1 micron tolerance.

Figure 4B:
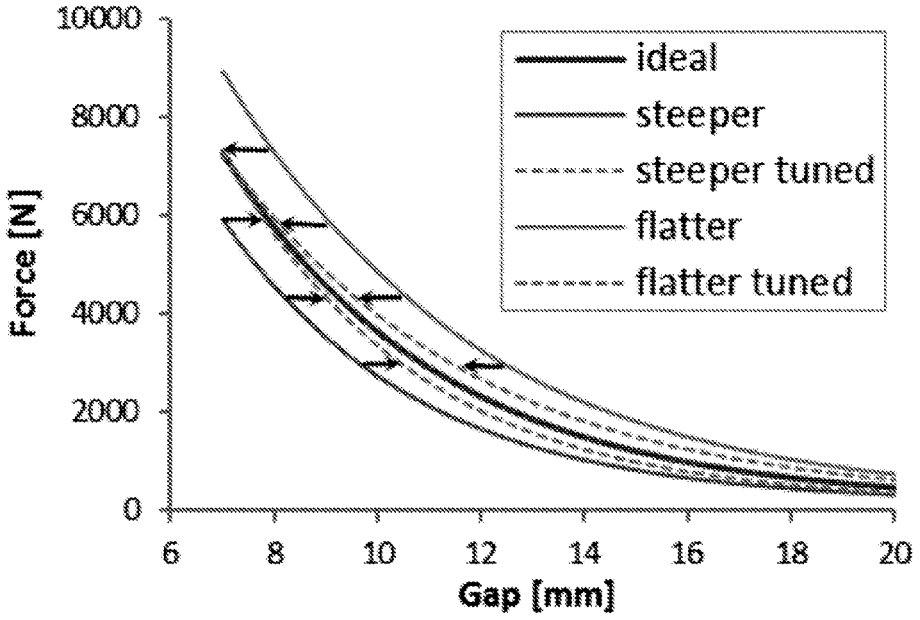
FIG. 4B illustrates example spring forces versus gap with tuning by preloading or loosening of springs for the example conical spring cage of FIG. 1 in accordance with a preferred embodiment.

Referring to FIG. 4B, there are shown example spring forces versus gap generally designated by the reference character 420 with tuning by preloading or loosening of springs for the example conical spring cage 114 of FIG. 1 in accordance with a preferred embodiment. In FIG. 4A, force in N is shown with respect to the vertical axis and gap 110 in mm is shown with respect to the horizontal axis.

In accordance with features of the invention, the design also includes the option to preload or loose the springs in order to decrease the difference magnetic compensation forces for the operational gap range. Such preloading does not change loading characteristics of a spring (its steepness), it just shifts it with respect to a gap 110 as illustrated in FIG. 4B. As a result, a magnetic force curve and spring compensation force curve will intersect. In order to avoid potential actuator backlash in the point of the intersection, the spring's tuning process is provided to eliminate the intersection in the operational gap range. Part of this process includes sorting the spring sets 112 of spring cages 114 to achieve better matching of overall spring curve and magnetic curve.

In accordance with features of the invention, a short prototype (847-mm-long) of an undulator 100 or Insertion Device (ID) 100 with the dynamic compensation of ID magnetic forces has been designed, built and tested at the Advanced Photon Source (APS) of the Argonne National Laboratory. The ID magnetic forces were compensated by the set of conical springs 112 placed along the ID strongback 104. Well-controlled exponential characteristics of conical springs 112 permitted a very close fit to the ID magnetic forces. Several effects related to the imperfections of actual springs 112, their mounting and tuning, and how these factors affect the prototype performance has been studied. Finally, series of tests to determine the accuracy and reproducibility of the ID settings of the magnetic gap 110 have been carried out. Based on the magnetic measurements of the ID $B_{eff}$, it has been demonstrated that the magnetic gaps 110 within an operating range were controlled accurately and reproducibly within ±1 micron. Successful tests of this ID prototype undulator led to the design of a 3-m (three meter) long device based on the same concept. The 3-m long prototype is currently under construction. It represents R&D efforts by the APS toward APS Upgrade Project goals as well as the future generation of IDs for the LCLS.

In accordance with features of the invention, the undulator 100 is a variable-gap hybrid permanent magnet undulator that is gravity neutral and uses a novel spring system for the dynamic compensation of the ID magnetic forces. The undulator 100 delivers vertically polarized radiation. The 847-mm-long prototype undulator 100 with the dynamic compensation of the magnetic forces was built and tested to assess the quality of its performance. The prototype undulator 100 uses conical springs 112 with the exponential load characteristics that generally perfectly match the behavior of magnetic forces as a function of gap 110. The load characteristics for springs 112 were set according to the magnetic force calculated for the prototype by means of the Opera software.

In accordance with features of the invention, prior to the final magnetic characterization of the prototype undulator 100, its mechanical performance has been extensively studied. The main purpose of these studies was the identification and consequent elimination of several important factors that could contribute to the performance quality. For example, the important factors include the backlash in the drive actuators; a friction in the slides; and a range of forces where mechanical components, such as spring cages 114 and strongbacks 104, are operating only within the elastic deformation mode. The prototype undulator 100 was equipped with several force load cells 120 and absolute encoders 118 that were instrumental to determine the spring load settings as well as the operational gap range. Extensive experiments were conducted to define the performance and limitations of prototype undulator 100. The tests of the prototype undulator 100 showed that the loading mechanism is able to provide compensation of the magnetic forces down to gap 10 mm (9066 Gauss effective field) with the reproducibility of the Beff better than 10-4. The results of multiple magnetic measurements showed that the device built on the basis of this novel design will meet stringent requirements for FEL-type undulators and IDs for next generation synchrotron radiation sources.

Figure 5:
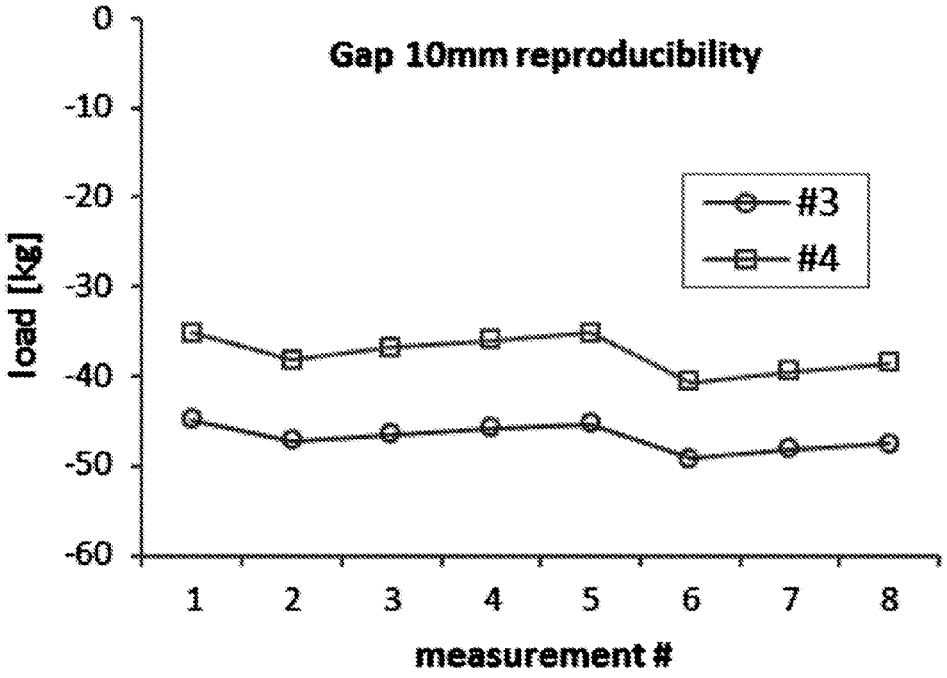
FIG. 5 illustrates example load acting on actuators of the example apparatus for implementing dynamic compensation of magnetic forces of FIG. 1 during gap closing and opening and full cycle down to 10 mm gap with reproducibility of the load for gap 10 mm in accordance with a preferred embodiment.

FIG. 5 illustrates the reproducibility of the force load on the drive actuators 116, #3 and 4, for several consecutive prototype gap settings at 10 mm.

Referring to FIG. 5, there are shown example load acting on actuators 116 generally designated by the reference character 500 of the example undulator 100 for implementing dynamic compensation of magnetic forces of FIG. 1 during gap closing and opening and full cycle down to 10 mm gap with reproducibility of the load for gap 10 mm in accordance with a preferred embodiment.

The magnetic performance of the prototype undulator 100 has been studied. A Hall probe sensor (not shown) has been used to measure $B_{eff}$ and phase errors. The Hall probe holder has been modified to access the vertical magnetic gap of the prototype apparatus 100. The main goal of the magnetic performance evaluation is to identify the accuracy and reproducibility of the new ID gap drive system of undulator 100. The magnetic tuning to straiten the trajectory and decrease the phase errors has not yet been performed.

In order to avoid any backlash of the drive system of undulator 100 of the preferred embodiment, desired gap settings has always been approached in the same direction. Furthermore, a special feature to control the fixed gap was added into the gap control software. This was done to avoid any drift after the gap reached its nominal value. All tested gaps between 20 and 10.5 mm were kept stable within ±0.1 μm range due to this feature. The measurements were performed in the following way. Gap 20 mm was chosen as the initial gap for each repetition. Then the gap was decreased down to 15 mm followed by 12 mm after that desired gap was reached. This sequence of steps (20 mm gap, 15 mm gap, 12 mm gap being tested) was applied to keep the speed of the actuators 116 low enough, which allowed one to reach desired gap in one approach without slipping. After measuring of the field map, the gap was increased up to 20 mm again for the next repetition.

Figure 6A:
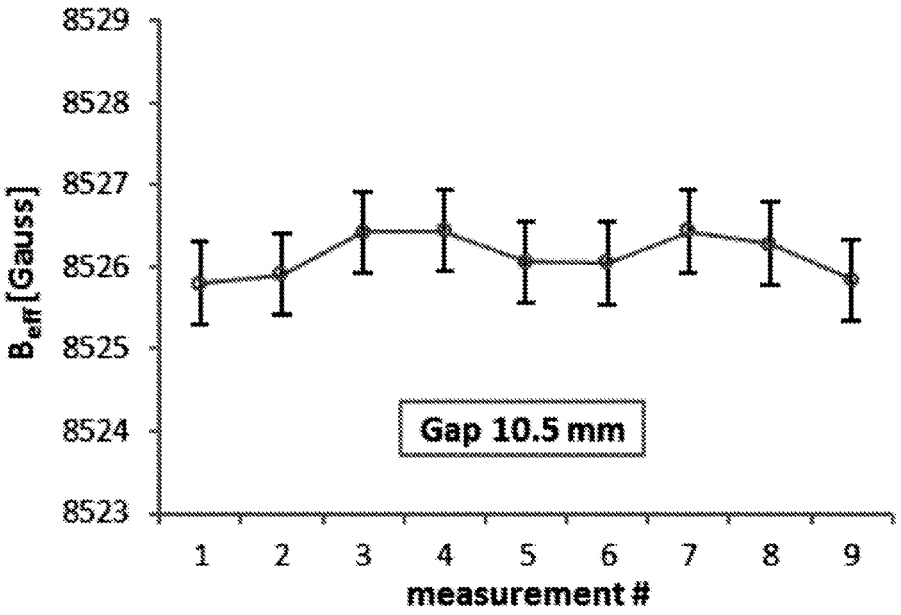
FIG. 6A illustrates example magnetic force versus gap for the example apparatus for implementing dynamic compensation of magnetic forces of FIG. 1 in accordance with a preferred embodiment.

FIG. 6A illustrates example magnetic force versus gap generally designated by the reference character 600 for the example undulator 100 for implementing dynamic compensation of magnetic forces of FIG. 1 in accordance with a preferred embodiment.

Figure 6B:
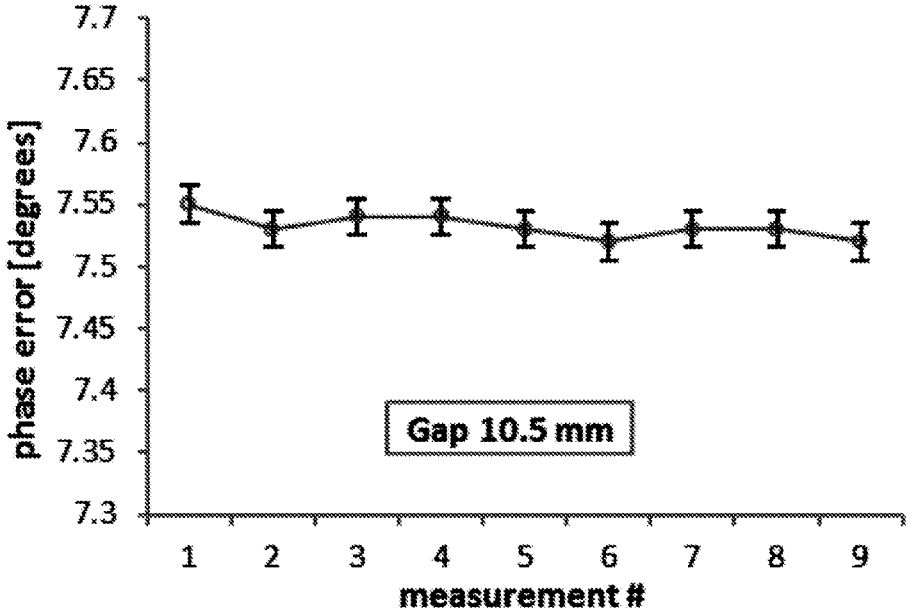
FIG. 6B illustrates example phase error versus gap for the example apparatus for implementing dynamic compensation of magnetic forces of FIG. 1 in accordance with a preferred embodiment.

FIG. 6B illustrates example phase error versus gap generally designated by the reference character 620 for the example undulator 100 for implementing dynamic compensation of magnetic forces of FIG. 1 in accordance with a preferred embodiment.

Figure 7A:
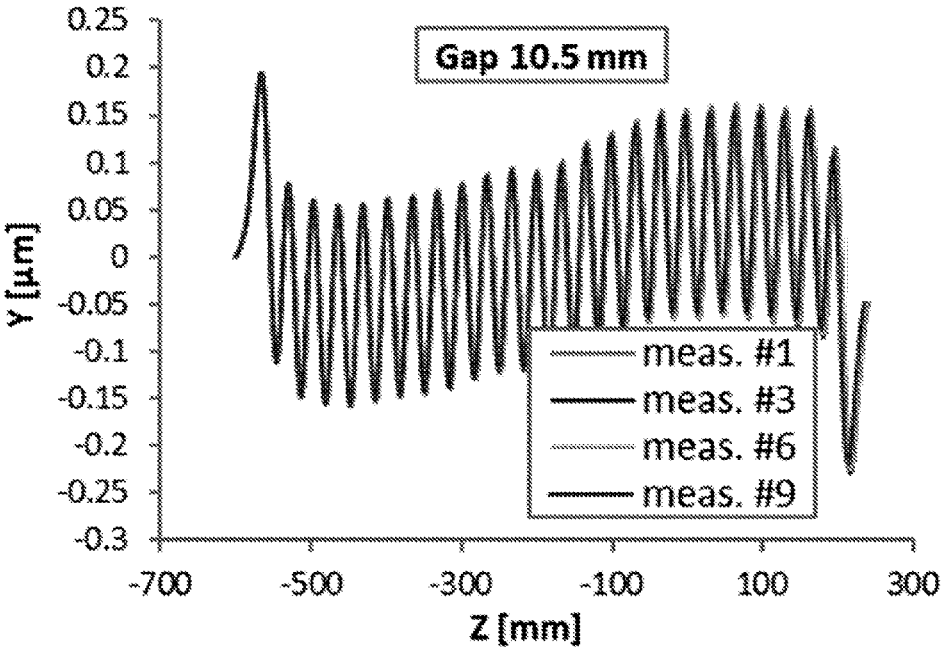
FIGS. 7A and 7B illustrate example reproducibility of reference particle for gap 10.5 mm for the example apparatus for implementing dynamic compensation of magnetic forces of FIG. 1 in accordance with a preferred embodiment.
Figure 7B:
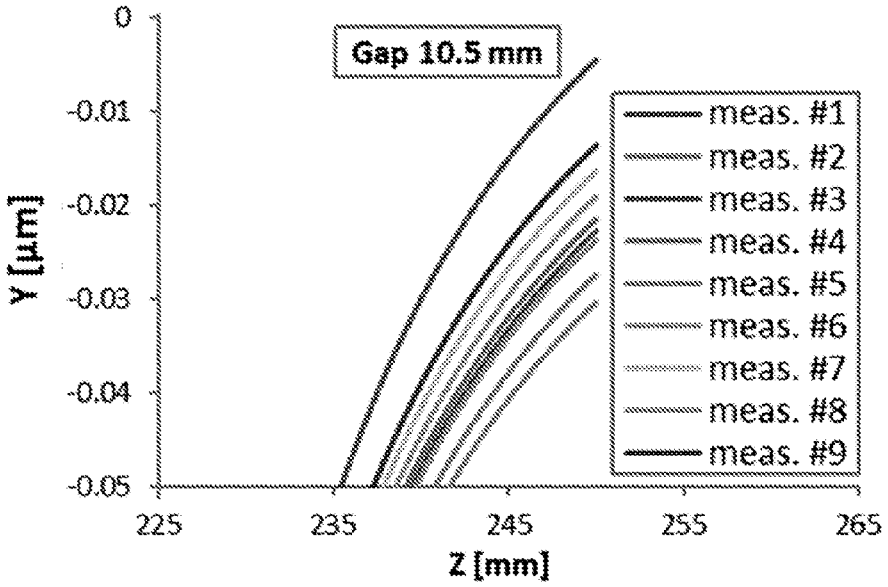

Referring also to FIGS. 7A and 7B, there are shown example reproducibility of reference particle for gap 10.5 mm for the example apparatus 100 for implementing dynamic compensation of magnetic forces of FIG. 1 in accordance with a preferred embodiment.

The effective field $B_{eff}$ and phase error reproducibility of undulator 100 for gap 10.5 mm can be observed in FIGS. 6A and 6B, the reproducibility for trajectory of a reference particle (13.5 GeV) in FIGS. 7A and 7B.

As one can see from FIG. 6A, all deviation of the undulator effective field $B_{eff}$ from the mean value is less than 1 Gauss. Standard deviation from the mean value for $B_{eff}$ is 0.328 Gauss. The same case with phase errors measurements can be seen in FIG. 6B. The maximum difference between the values is 0.03 Degrees. Standard deviation from the mean value for phase error is 0.01 Degrees. The discrepancies between trajectories are small enough, the maximum difference is 0.026 μm. All these deviations are within measuring accuracy. According to these findings, there is no field change connected with inelastic deformations of strong-backs or loading mechanism, and the magnetic properties of the device are reproducible at 10.5 mm gap (8526 Gauss $B_{eff}$ field) within the accuracy range set in the requirements.

Figure 8:
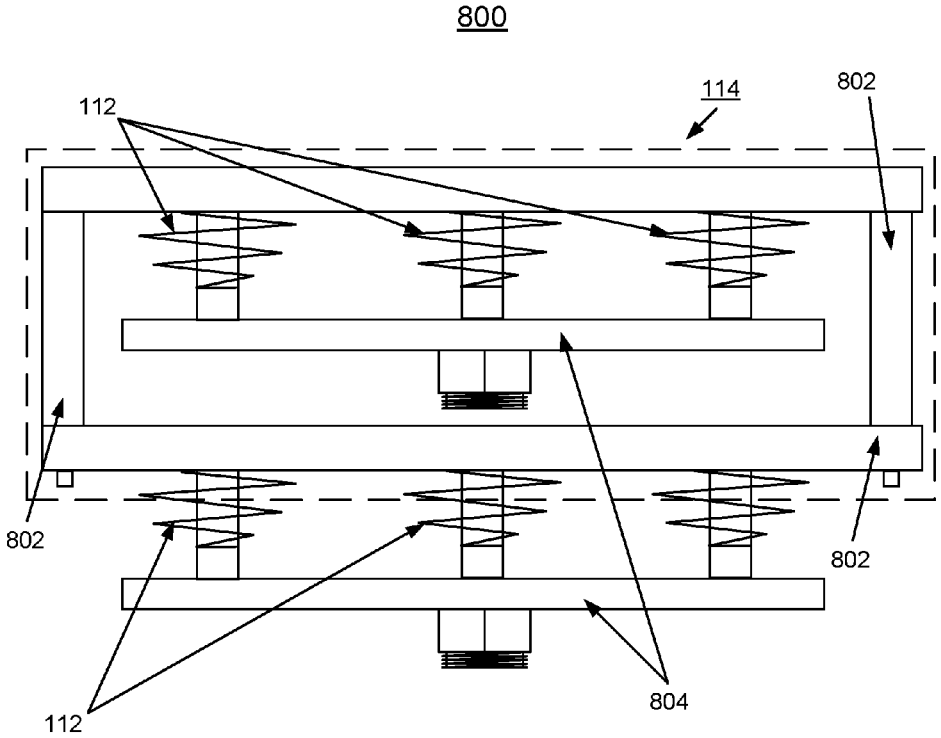
FIG. 8 illustrates an example conical spring cage for the example apparatus for implementing dynamic compensation of magnetic forces of FIG. 1 in accordance with a preferred embodiment.

Referring now to FIG. 8, an example conical spring cage generally designated by the reference character 800 for the example undulator 100 for implementing dynamic compensation of magnetic forces of FIG. 1 in accordance with a preferred embodiment.

The example conical spring cage 800 implementing spring cages 114 contain a plurality of compensation springs 112, including multiple support members 802 coupled to at least one compression disk 804.

While the present invention has been described with reference to the details of the embodiments of the invention shown in the drawing, these details are not intended to limit the scope of the invention as claimed in the appended claims.

What is claimed is:

1. An apparatus for implementing dynamic compensation of magnetic forces for undulators comprising:

an undulator including a respective set of magnet arrays, each set of magnet arrays attached to a respective strongback, and placed on horizontal slides and positioned parallel relative to each other with a predetermined gap;

a respective set of four conical springs provided with a respective spring cage and placed along each said strongback for compensating undulator magnetic forces; and each of said conical springs having exponential force characteristics and being adjusted for precise tuning of conical force compression, and each said respective set of four conical springs being positioned along the length of the magnets; and each said respective set of four conical springs generating a mechanical force to substantially match said undulator magnetic forces.

2. The apparatus as recited in claim 1 wherein each said respective set of four conical springs include said exponential force characteristics arranged to match exponential characteristics of said magnetic forces.

3. The apparatus as recited in claim 1 wherein said respective spring cages are provided with a mechanical design that enables both reliable and reproducible generation of the compensation force.

4. The apparatus as recited in claim 1 includes at least one spring cage having a compression disc coupled to said four conical springs.

5. The apparatus as recited in claim 1 includes at least one spring cage having a support members coupled to at least one compression disk, said compression disc coupled to said four conical springs.

6. The apparatus as recited in claim 1 includes each said respective spring cage containing said set of said four conical springs.

7. The apparatus as recited in claim 1 wherein said conical springs are conical wire springs with constant wire cross section.

8. The apparatus as recited in claim 1 wherein each of said conical springs have load characteristics set according to a predefined magnetic force of the undulator.

9. The apparatus as recited in claim 1 wherein overall load characteristics of said four conical springs in a spring cage block are selectively set steeper or flatter than the predefined magnetic force of the undulator.

10. The apparatus as recited in claim 1 wherein overall load characteristics of said four conical springs in a spring cage block have a difference between magnetic force and spring compensation force of less than a predefined allowable actuator force.

11. The apparatus as recited in claim 1 wherein overall load characteristics said four conical springs in a spring cage block have a gap distortion of less than a predefined tolerance.

12. The apparatus as recited in claim 11 wherein said gap distortion is less than ±10 micron tolerance.

13. The apparatus as recited in claim 11 wherein said gap distortion results by a differential torque on the strongback and said predefined tolerance equals ±1 micron tolerance.

14. The apparatus as recited in claim 1 includes predefined matching of overall spring curve and magnetic curve provided by selecting spring sets to provide spring sets having substantial matching of overall spring curve and magnetic curve.

15. The apparatus as recited in claim 1 includes a plurality of actuators, a plurality of force load cells coupled between respective actuators and each said respective strongback used to determine spring load settings and at least one force load cell absolute encoder attached to one said respective strongback used to determine an operational gap range between each set of magnet arrays attached to each said respective strongback.

16. A method for implementing dynamic compensation of magnetic forces for undulators comprising:

providing an undulator including a respective set of magnet arrays, each set of magnet arrays attached to a strongback, and placed on horizontal slides and positioned parallel relative to each other with a predetermined gap;

providing a respective set of four conical springs provided with a respective spring cage and placed along each said strongback for compensating magnetic forces; and implementing each of said conical springs having exponential force characteristics and being adjusted for precise tuning of conical force compression, and each said respective set of four conical springs being positioned along the length of the magnets; and each said respective set of four conical springs generating a mechanical force to substantially match said undulator magnetic forces.

17. The method as recited in claim 16 wherein providing said set of four conical springs includes providing conical wire springs having constant wire cross section.

18. The method as recited in claim 16 wherein providing said set of four conical springs includes providing said conical springs having said exponential force characteristics arranged to match exponential characteristics of said magnetic forces.

19. The method as recited in claim 16 wherein providing said set of four conical springs includes providing said spring cage containing a plurality of conical springs coupled to at least one compression disk.

20. The method as recited in claim 16 includes providing each of said conical springs having load characteristics set according to a predefined magnetic force of the undulator.

* * * * *